United States Patent [19]

Desmidt

[11] Patent Number: 4,664,625

[45] Date of Patent: May 12, 1987

[54] METHOD AND APPARATUS FOR HEAT TREATMENT, CAPABLE OF BEING USED FOR MAKING A HYDRAULIC BINDER, INCLUDING A POST-COMBUSTION STEP

[75] Inventor: François Desmidt, Garches, France

[73] Assignee: Cle Group Technip, France

[21] Appl. No.: 795,640

[22] Filed: Nov. 6, 1985

[30] Foreign Application Priority Data

Nov. 12, 1984 [FR] France ..... 84 17213
Oct. 18, 1985 [FR] France ..... 85 15483

[51] Int. Cl.[4] ..... F27B 15/00

[52] U.S. Cl. ..... 432/58; 432/14; 432/106

[58] Field of Search ..... 432/58, 106, 14

[56] References Cited

U.S. PATENT DOCUMENTS

| | | | |
|---|---|---|---|
| 4,014,641 | 3/1977 | Shigeyoshi et al. | 432/58 |
| 4,105,396 | 8/1978 | Ritzmann | 432/14 |
| 4,169,701 | 10/1979 | Katayama et al. | 432/106 |
| 4,248,639 | 2/1981 | Tuittkat | 432/58 |
| 4,315,734 | 2/1982 | Ramesohl et al. | 432/14 |
| 4,363,668 | 12/1982 | Herchenbach | 432/106 |
| 4,372,784 | 2/1983 | Hess | 432/106 |
| 4,381,916 | 5/1983 | Warshawsky | 432/106 |
| 4,465,460 | 8/1984 | Cosar | 110/347 |

FOREIGN PATENT DOCUMENTS

| | | |
|---|---|---|
| 2280601 | 2/1976 | France . |
| 2384727 | 10/1978 | France . |
| 1406965 | 9/1975 | United Kingdom . |
| 2028475 | 8/1978 | United Kingdom . |

*Primary Examiner*—Henry C. Yuen

[57] ABSTRACT

This invention relates to a method and an apparatus for heat treatment of a powder material comprising a device for post-combustion of the combustible constituent remaining in the powder material which contains, or is mixed with, a constituent apt to cause an exothermic reaction either with a gas or with another constituent, proceeding from a precalciner ensuring a primary combustion of the said constituent, so as to achieve the complete combustion of the said constituent.

5 Claims, 6 Drawing Figures

105
110
104
106
102
103
111
109
101
108

226a
226b
226
205
210
204
202
206
224
219
214
203
228
218
211
212
209
216
220
222
211
201
208

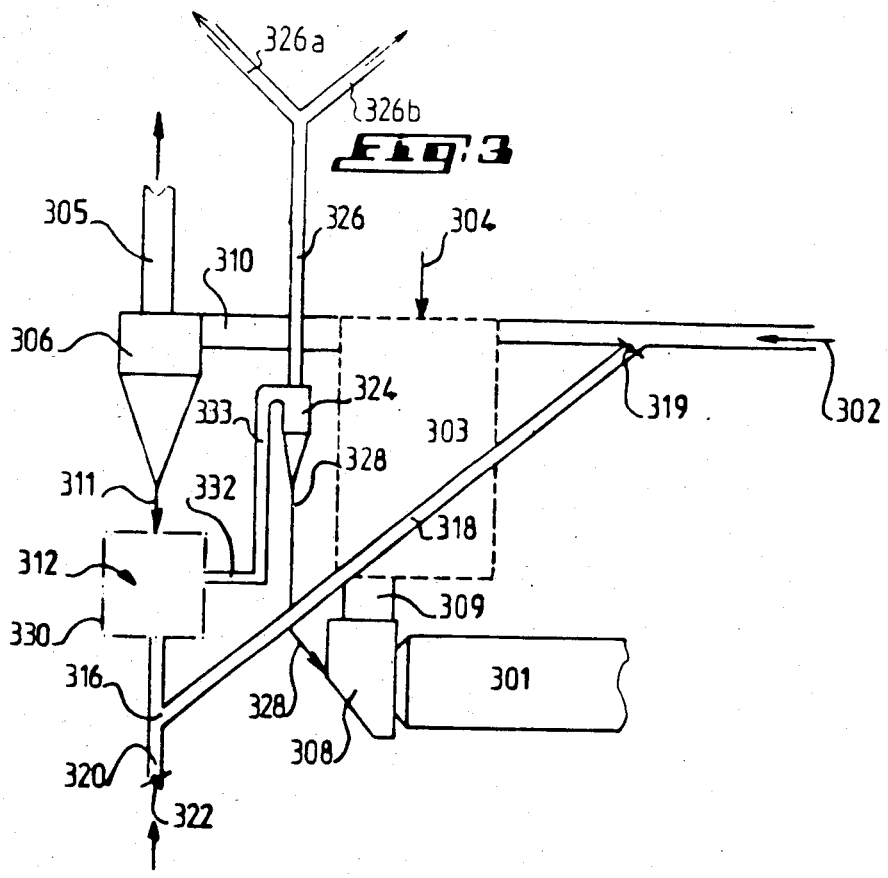
Fig. 3
Fig. 6
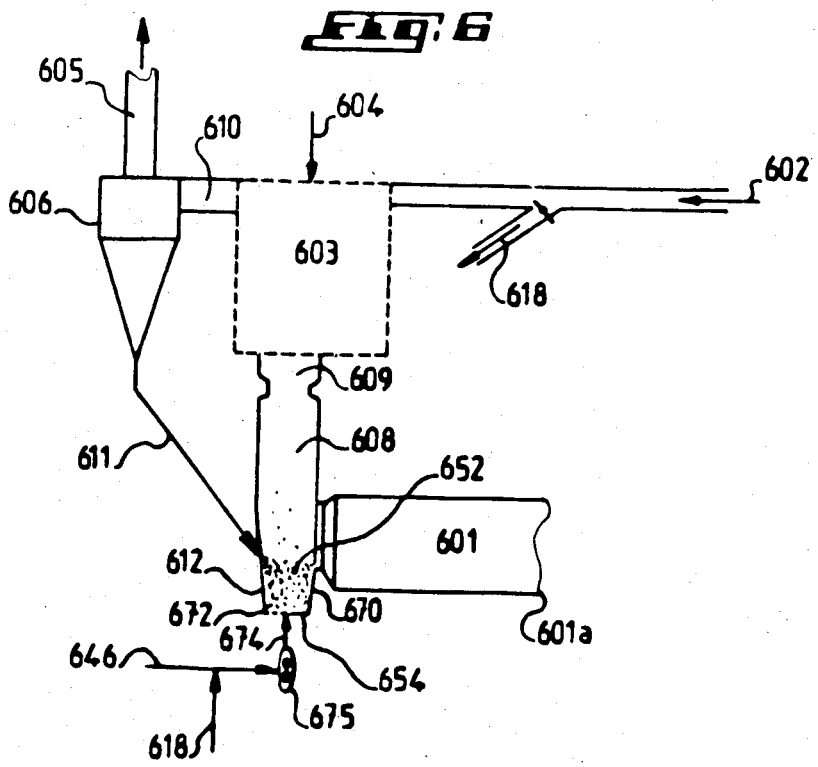

405
406
410
404
402
403
418
411
450
409
408
462
401
466a
452
466b
466
412
464
455
454
456
457
458
446
459
460
418

526a
526b
505
526
510
504
506
502
503
518
550
552
511
512
554
509
557
558
508
501
546
559
518
560

METHOD AND APPARATUS FOR HEAT TREATMENT, CAPABLE OF BEING USED FOR MAKING A HYDRAULIC BINDER, INCLUDING A POST-COMBUSTION STEP

BACKGROUND OF THE INVENTION

The present invention relates essentially to a method and an apparatus for heat treatment capable of being used for making a hydraulic binder, including a post-combustion step.

Up to the present time, the recent methods and apparatuses for making, for example, a hydraulic binder, include a previous step of precalcining of a powder material suitable for making a hydraulic binder, which may be a cement clinker, in a precalciner, and a step of calcining or burning proper in a calcining or burning kiln, which may be a clinkering kiln. The precalcining is usually performed as illustrated in FIG. 1 of the appended drawings by suspending the powder material by means of various gases, in particular by means of gases proceeding from the calcining kiln, as well as, advantageously, the hot air recovered from the cooler.

The powder material may contain a component capable of producing an exothermic reaction either with a gas or with another component. However, particularly in the case of cement clinker making, when the basic powder material does not contain such a component capable of causing an exothermic reaction, usually referred to as the "combustible", it must be mixed with such a combustible component.

Now the present tendency is towards the use of cheap combustibles. Of course, such inexpensive combustibles do not have the same properties, particularly, of reactivity and of aptitude to grinding, as the combustibles of the higher qualities.

As is well known in the art, the poorer the quality of the raw material or the combustible used, the more difficult it is to correctly carry out the method of making the hydraulic binder, particularly the cement clinker. Moreover, it is generally recognized by those conversant with the art that the presently known apparatuses must be extensively modified to ensure a correct making of the hydraulic binder, in particular consisting of a cement clinker.

Indeed, as is well known, the previous step of precalcining constitutes an essential step in the preparation of the raw material before the heat treatment for the making of the hydraulic binder in the calcining or burning zone. It is also readily understood that such previous combustion is much more difficult to achieve when the initial combustible is of poor quality and therefore more economical. Among such initial combustibles are for example the poorest coals, the charcoals, the petroleum cokes, etc.

Of course, the combustion during the precalcining step could be improved by increasing the time of presence in the precalciner.

The time of presence of the gases in the precalciner reflects the time of presence of the material and of the combustible.

Now this time of presence of the gases is directly related to the volume of the precalciner.

If it is desired, for example, to double the time of presence, the volume of the precalciner must be at least doubled.

Thus, for example, in an apparatus for the production of 2,000 tons of clinker per day, the volume of the precalciner is 160 $m^3$ and the doubling of such an apparatus is impracticable from the technological point of view.

SUMMARY OF THE INVENTION

The present inventor therefore set to himself the new technical problem consisting in providing a new method and a new apparatus which would allow using more economical combustibles for the making of, for example, a hydraulic binder, in particular a cement clinker, without however necessitating any modifications of the existing calcining devices or precalciners and preferably resulting at the same time in an improved heat balance compared to the heat balance of the previously known methods and apparatuses.

This technical problem is resolved by the present invention.

On the other hand, the present invention also has for a purpose to provide a solution which would allow only very slightly modifying the previously known heat treatment methods and apparatuses, e.g. those used for the making of hydraulic binders, and also preferably affording the possibility of reversible operation to allow, when desired, the use of combustibles of excellent quality in the same apparatus. Otherwise stated, the solution provided by the present invention must also allow the simultaneous use of combustibles widely differing in reactivity.

Thus, according to one of its aspects, the present invention provides a heat treatment method capable of being used for the making of a hydraulic binder, such as a cement clinker, from a suitable powder material preferably containing, or mixed with, a component capable of producing an exothermic reaction either with a gas or with another component, preferably including a preheating step followed by a previous step of precalcining in a precalcining zone in which the said component is subjected to a primary combustion, particularly by means of a combustive gas, and a step of calcining or burning proper in a zone of heat treatment termed a calcining or burning zone, characterized in that, with a view to, particularly, reducing the proportion of unburnt substances, there is performed, between the precalcining step and the calcining or burning step, a step of post combustion of the said component remaining in the said powder material in a post-combustion zone.

According to a preferred feature of the method of the invention, the latter is characterized in that the volume of the post-combustion zone is predetermined according to the necessary time of presence in the post-combustion zone to achieve a complete combustion of the said component and ranges from approximately 1/10th to 1/50th of that of the precalcining zone.

According to a particular feature of the method of the invention, the latter is characterized in that the post-combustion zone is situated in the circuit for the transfer of the powder material from a separation stage forming part of the preheating stage which separates the precalcined material from the gases and feeds the same to the calcining zone.

According to a first form of embodiment of the method of the invention, the latter is characterized in that the post-combustion is caused to take place by suspending the powder material in a combustive gas which advantageously is preheated, and is preferably constituted at least partially by the hot air proceeding from a zone of cooling of the calcined or burnt material discharged from the calcining zone. According to a variation of embodiment, a step of separation of the powder material from the suspension gas is performed in an auxiliary separation zone.

The method is also characterized in that at least a portion of the dust-containing gases proceeding from the post-combustion step is treated and recycled and/or rejected to the atmosphere in order to eliminate the undesired volatile compounds.

According to another feature, another portion of the said dust-containing gases may be recycled to the precalcining or preheating step.

According to still another feature of the method, the gases proceeding from the post-combustion step are partially freed from dust in a cyclone separator and a fraction of the dust thus recovered is recycled to the calcining step.

The method is further characterized in that, during the post-combustion step, the conditions of oxidation reduction potential temperature or of chemical potential of an element other than oxygen is controlled to optimise the conditions of volatilization of the harmful volatile compounds.

According to another one of its aspects, the present invention also provides an apparatus for heat treatment, which can be used for making a hydraulic binder, such as cement clinker, from a suitable powder material, preferably containing, or mixed with, a component apt to produce an exothermic reaction either with a gas or with another component, preferably including a system for the preheating of at least the powder material, followed by a precalciner performing a primary combustion of the said component, followed by a stage of separation of the powder material from the gases, forming part of the preheating system, and a heat treatment kiln referred to as a calcining or burning kiln, characterized in that it includes, between the precalciner, preferably between the said separation stage, and the calcining or burning kiln, a device for the post-combustion of the said component remaining in the said powder material.

According to a particular form of embodiment of the apparatus of the invention, the volume of the post-combustion device is adapted to the time of presence necessary to carry out the post combustion, the said volume ranging from about 1/10th to about 1/50th of the volume of the precalciner. Preferably, the post-combustion device is situated in the powder material transfer circuit connecting the separation stage to the calcining or burning kiln.

According to a first form of embodiment, the post-combustion device includes a re-suspending duct controllably fed with combustive gas through at least one combustive gas supply conduit, the said gas preferably consisting of hot air proceeding from the system for cooling the calcined or burnt material discharged from the kiln, according to a flow rate ensuring the suspending of the powder material in the said gas.

According to still another form of embodiment, the post-combustion device includes a fluidizing chamber including a fluidizing grate.

According to still another form of embodiment, the post-combustion device is designed in the form of a fluidized siphon ensuring the transfer of the powder material to the kiln. Thus, owing to the above-described method and apparatus of the invention, including a post-combustion step, the time of presence in the system of treatment of the powder material before the kiln used for the calcining and burning proper can be modulated at will in such a manner as to adapt the time of presence according to the specific character of the powder material or of the component producing an exothermic reaction, or combustible component. Thus, in the case of a combustible of low reactivity, the time of presence in the post-combustion zone can be modulated in such a manner as to reduce the proportion of unburnt substances proceeding from the precalcining zone by a limited amount of combustive gas, generally of air.

Thus, the method and apparatus of the invention allow completely controlling the evolution of the time of presence while necessitating only minor modifications in the previously known methods and apparatuses, such as those used for making a hydraulic binder. Furthermore, the method and apparatus of the invention allow using combustibles contained in, or mixed with, the powder material, which are more economical. Among these are for example the poorest coals, the charcoals, petroleum coke, whose combustion cannot be complete in the precalcining zone in which the time of presence is limited.

It will also be pointed out that the apparatus according to the invention is characterized by the fact that the outlet of the post-combustion device is provided with at least one conduit for the discharge of at least a portion of the dust-containing gases loaded with harmful volatile compounds.

The apparatus of the invention is also characterized in that the outlet of the post-combustion device is provided with at least one other conduit for recycling another portion of the dust-containing gases to the aforesaid precalciner or to the aforesaid preheating system.

BRIEF DESCRIPTION OF THE DRAWINGS

Other purposes, features and advantages of the invention will appear from the following explanatory description made with reference to several, presently preferred forms of embodiment of the apparatus of the invention, allowing the carrying out of the above described invention, given solely by way of example and which should in no way be construed as limiting the scope of the invention. In the drawings:

FIG. 3 illustrates a second form of embodiment of an apparatus according to the present invention;

FIG. 6 illustrates a fifth form of embodiment of an apparatus according to the invention.

DESCRIPTION OF THE PREFERRED EMBODIMENTS

Figure 1:
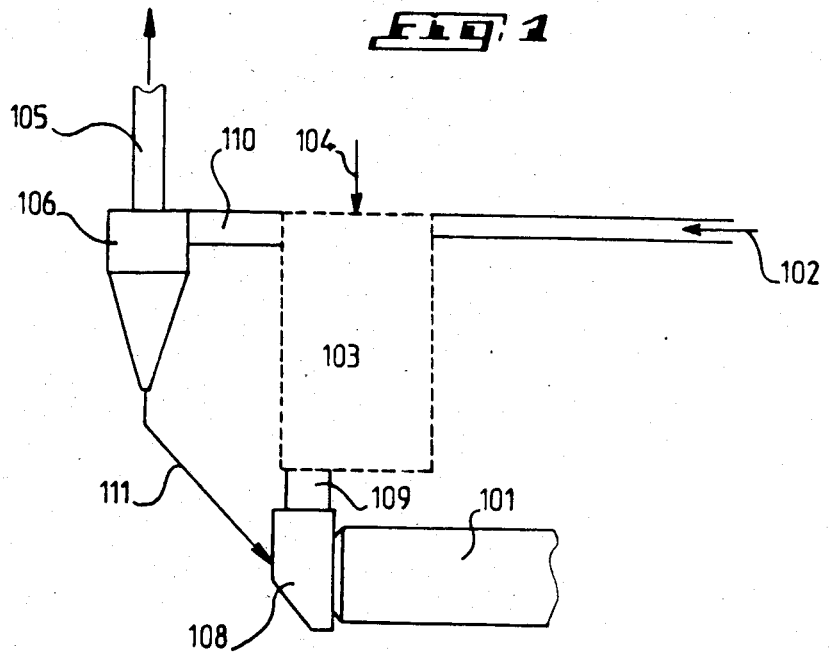
FIG. 1 is a diagrammatic view of a conventional apparatus for the making of a hydraulic binder, particularly a cement clinker, in the region of the precalciner and of the calcining or burning kiln which is generally constituted by a revolving kiln.

Referring to FIG. 1, there is illustrated a form of embodiment of a conventional apparatus for making a hydraulic binder, constituted particularly by a cement clinker, from a suitable powder material preferably containing, or mixed with, a component apt to produce an exothermic reaction either with a gas or with another component. The powder material generally is a conventional raw material, usually termed meal, supplied from a grinding workshop, previously preheated and then introduced through a conduit 104 into the precalciner 103. This powder material may be previously mixed with the constituent apt to cause an exothermic reaction, or combustible component, or, in some cases, the combustible component may be introduced separately into the precalciner 103. On the other hand, there is generally introduced into the precalciner, through a conduit 102, a gas for the combustion of the combustible component, this gas preferably consisting of hot air recovered from the clinker cooler, which is located downstream of the calcining or burning kiln 101.

Furthermore, the calcining or burning kiln 101 generally consists of a revolving kiln which is provided with a smoke box 108 from which the gases proceeding from the calcining or burning kiln 101 rise through a conduit 109 leading to the precalciner 103. The mixture of powder material, combustible component and gases, in particular combustion air, is discharged from the precalciner 103 through a conduit 110 towards a preheating system including a lower stage 106 of separation of the gases from the solid materials. The gases flow through a conduit 105 to an upper stage of the preheating system, whereas the solid materials are transferred by gravity through a transfer conduit 111 to the calcining or burning kiln 101 through the medium of the smoke box 108. By way of example, in a unit for the production of 2,000 tons of clinker per day, the volume of the precalciner 103 and of the connecting conduits 109, 110 is about 160 $m^3$, and this volume corresponds to a time of presence of the gases in the precalciner of about 1.4 seconds. It is thus understood that where use is made of a combustible component of poorer quality, i.e. of lower reactivity, it is necessary to increase the said time of presence.

By way of example, where it is desired to increase the time of presence of the gases from 1.4 to 2.0 seconds in order to use such poorer combustible, it is also necessary to increase by at least 60 $m^3$, i.e. by about 40%, the volume of the assembly constituted by the precalciner and the connecting conduits.

It is understood that it is very difficult to modify the existing apparatuses to this end, and that, in the case of new apparatuses, this would result in radically increasing costs. On the other hand, this solution is not practicable because, in case use should be made, at certain times, of rich combustibles, i.e., combustibles of good reactivity, the volume of the precalciner 103 would be too large. The present invention allows remedying these drawbacks in a manner which is new and unobvious to a person conversant with the art.

Figure 2:
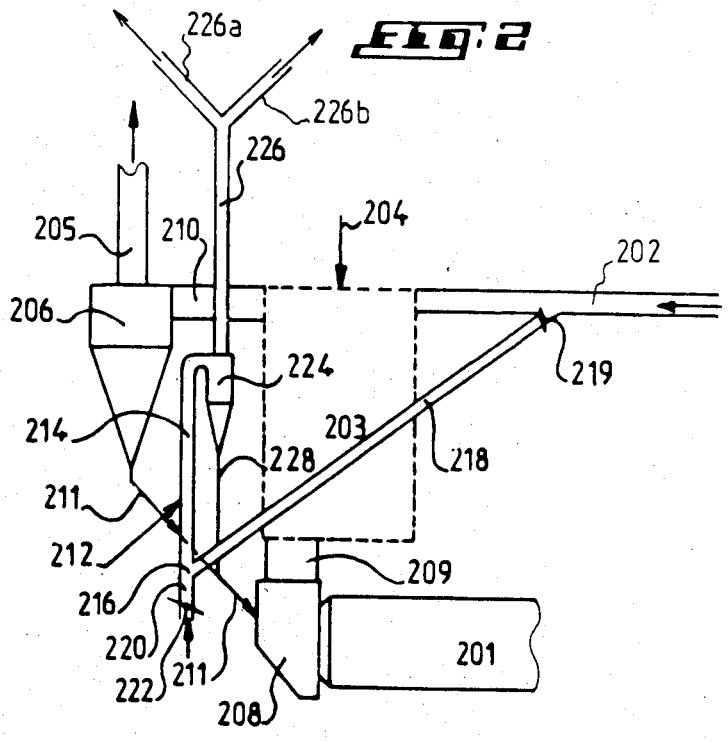
FIG. 2 illustrates a first form of embodiment of the present invention.

Referring to FIG. 2, there is shown a first form of embodiment of an apparatus according to the invention, in which use is made of the same reference numerals to designate the same elements as those of the conventional apparatus of FIG. 1, increased by 100. Thus, the precalciner is designated by the reference numeral 203, and so on.

According to the present invention, the apparatus is characterized in that it includes a post-combustion device, designated by the general reference numeral 212, which, in the case considered, is preferably arranged between the lower stage of separation 206 of the preheating system and the calcining or burning kiln 201, performing a post-combustion of the powder material which contains a variable proportion of unburnt substances.

The volume of this post-combustion device 212 is adapted according to the proportion of unburnt substances which is transferred thereto, therefore according to the reactivity, in particular, of the combustible component introduced into the precalciner 203. Preferably, the volume of the post-combustion device 212 ranges from about 1/10th to about 1/50th of the volume of the precalciner 203 (with the connecting conduits 209 and 210).

Furthermore, the post-combustion device 212 receives through the conduit 211 the powder material proceeding from the lower stage of separation 206 of the preheating system.

The conduit 211 is so designed as to also be able to directly feed the kiln 201, i.e. to bypass the combustion device 212, thus enhancing the flexibility of the apparatus and of the method of the invention.

According to the form of embodiment illustrated in FIG. 2, the post-combustion device preferably includes a re-suspending duct 214 which advantageously is arranged substantially vertically. This re-suspending duct may be provided towards its base with a conduit upturn 216 including a conduit 218 for the supply of a combustive gas which preferably is constituted by hot air proceeding from the system for cooling the calcined or burnt matter discharged from the kiln 201, through the conduit 202. The conduit 218 therefore is a conduit which branches off from the conduit 202 as clearly appears from FIG. 2. The conduit 218 is laterally provided with a valve 219 allowing the flow rate of the combustive gas to be adjusted.

Furthermore, the base of the duct 214 is extended beyond the conduit upturn 216 by a conduit 220 provided with a valve 222 allowing a combustive gas, such as cold or hot air, to be supplied at will.

Preferably, and according to the form of embodiment illustrated, the upper portion of the re-suspending duct 214 leads to a separation stage 224, such as a cyclone, in which the powder material is separated from the combustion gas or from the carrier gas, the combustion or carrier gas leaving the separation stage 224 through a conduit 226, whereas the precalcined powder material no longer containing unburnt combustible substances is conveyed through a transfer conduit 228 to the kiln 201 through the medium of the smoke box 208.

It is thus understood that the post-combustion device according to the invention may very easily be added to any existing apparatus, this being also true of the method, thus allowing the use of combustibles of lower reactivity.

By way of example and of comparison with the conventional apparatus shown in FIG. 1, in order to obtain a complementary time of presence of 0.6 second in the post-combustion device 212, it is sufficient to provide a duct 214 of 5 $m^3$ volume, e.g. 0.5 m in diameter and 20 m in height. In the case of coal with a heating power of 5,000 kilocalories per kilogram, the quantity of coal that can be burnt in the duct 214 per hour is 1,600 kilograms (20% of the total quantity fed to the precalciner through the conduit 204).

To ensure this combustion, air may be supplied through the duct 214 at a rate of 11,000 $Nm^3$/hour. The rate of flow conveyed in the duct 214 will be about 100 tons per hour. The cyclone 224 associated with the duct 214 is about 1.50 m in diameter.

The loss of head in the assembly consisting of the duct 214 and the cyclone 224 will be from 5,000–5,500 pascals.

It is thus seen that, in order to increase by 40% the time of combustion in a precalciner, it is necessary, in a conventional apparatus, to also increase the volume of the precalciner by at least 40%.

In contrast, in the present invention, there is obtained the same increase in time of combustion in the post-combustion device 212 with a duct whose volume is of the order of 3% of that of the precalciner, which preferably is associated with a small cyclone.

Moreover, an important advantage of the post-combustion device lies in the fact that the portion of combustible that is most difficult to burn and is already preheated is again in contact with pure air.

Referring to FIG. 3, there is illustrated a second form of embodiment of an apparatus according to the invention, in which the same reference numerals are used to designate the portions identical with those of FIG. 2, but increased by 100. Thus, the precalciner is designated by the numeral 303 and the post-combustion device by the numeral 312. In this form of embodiment, the post-combustion device 312 includes a turbulence chamber 330 into the upper portion of which is supplied, through a transfer conduit 311, the powder material containing the particles of unburnt combustible, whereas the combustive gas is fed to the base of the chamber 330 through a conduit 320 provided with a conduit upturn 316 identical with that of the form of embodiment shown in FIG. 2.

The presence of this turbulence chamber 330 allows increasing the time of contact between the oxygen of the combustion air admitted through the conduits 318 and/or 320 and the particles of unburnt combustible to a greater degree than in the case of a simple re-suspending duct 214 as in the form of embodiment of FIG. 2.

Likewise, the calcined material is separated from the combustion gases by the cyclone 324. It will be noted here that the transfer of the mixture of calcined material and gas takes place through a lateral conduit 332 including a substantially vertical ascending portion 333 leading to the top of the stage of separation constituted by the cyclone 324. The separated material is introduced into the kiln through the conduit 328, whereas the combustion gases are discharged through a conduit 326.

Figure 4:
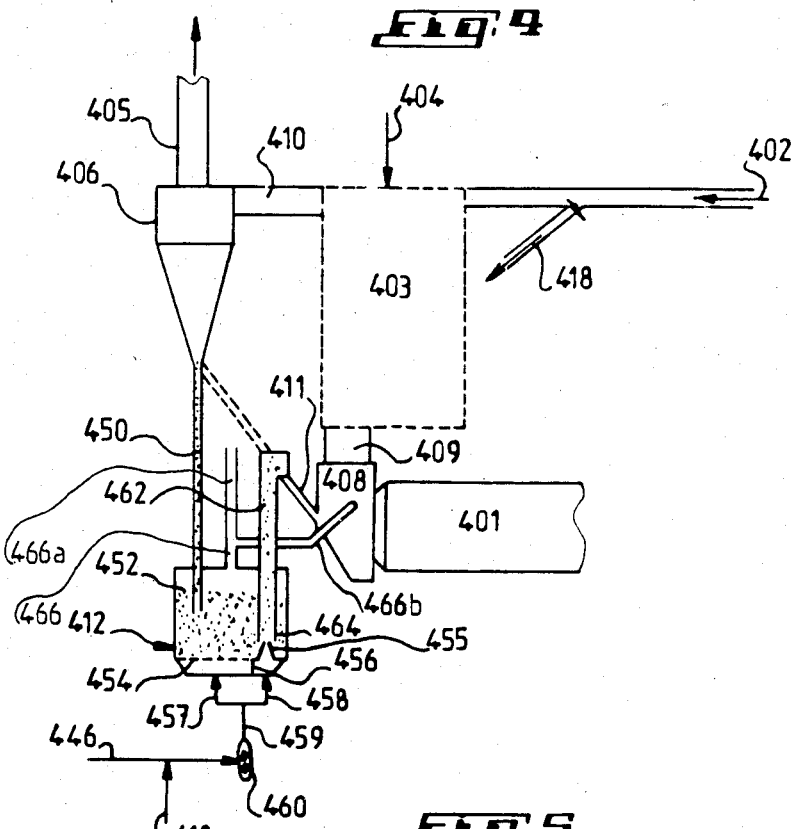
FIG. 4 illustrates a third form of embodiment of an apparatus according to the invention.

Referring to FIG. 4, there is shown still another form of embodiment of an apparatus according to the invention. Again, the portions common with those of FIG. 3 are designated by the same reference numerals increased by 100. Thus, the post-combustion device in this case is designated by the same general reference numeral 412.

In this form of embodiment, the conduit 411 for the transfer of the powder material from the lower stage of separation 406 to the kiln 401 through the medium of the smoke box 408 is again seen. The post-combustion device 412 is connected in parallel and is supplied with powder material from the lower stage of separation 406 by a vertical conduit 450 descending into the post-combustion device 412 including a chamber 452 in which is formed a fluidized bed. The chamber 452 includes a fluidizing grate 454 divided into two sections by a vertical partition 456, each section being supplied through separate supply means 457, 458 connected to a common conduit 459 provided with a fan or a pressure booster 460.

The air may be supplied through the conduit 418, or it may consist of cold or hot pure air supplied through the conduit 446. In this form of embodiment, the second section defined by the partition 456 is of reduced volume, and the discharge of the powder material takes place through a conduit 462 the lower orifice 464 of which opens in proximity to the grate 454 so that the air supplied through a nozzle 455 serves to expel the powder material into the conduit 462. As illustrated, the conduit 462 leads to the previously mentioned transfer conduit 411. Furthermore, the chamber 452 is provided at its top with a degassing conduit 466 connected through the conduit 466b to the smoke box of the kiln 401.

Owing to this arrangement, the air flows blown into the conduits 457, 458 may be very different so as to form two beds of very different densities and, therefore, of very different heights.

It is therefore seen that the solution provided by the invention allows greatly improving the flexibility of the apparatus of the invention as well as the associated method.

Figure 5:
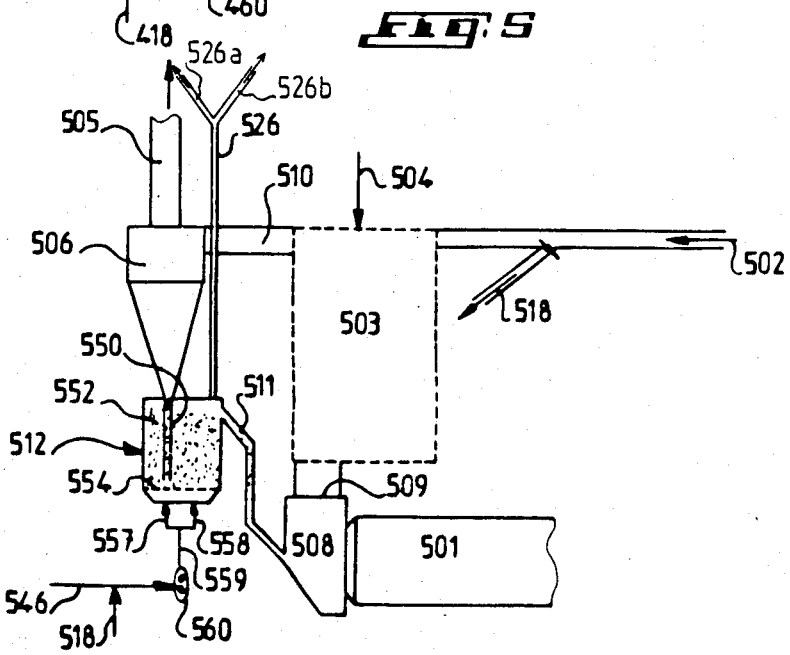
FIG. 5 illustrates a fourth form of embodiment of an apparatus according to the invention.

Referring to FIG. 5, there is seen another form of embodiment, in which the reference numerals of the common portions are increased by a further 100. As is seen in the Figure, the post-combustion device 512 also includes a chamber 552 provided with a fluidizing grate 554 supplied with air from the same means as those described in FIG. 4, but without the presence of a partition wall. In this form of embodiment, the powder material is fed to the chamber 552 through a vertical conduit 550 for downward flow of the powder material, and the discharge of the powder material from the post-combustion chamber 552 takes place by simple overflowing of the fluidized layer, the transfer conduit 511 being laterally connected to the upper portion of the fluidized layer. There is also provided a gas discharge conduit 526 similar to the conduit 226 of FIG. 2.

In this form of embodiment, times of presence of several minutes can be obtained.

In the above-described forms of embodiment, the combustion gases leaving the separation stage 224, 324 (FIGS. 2 and 3), or flowing out directly from the post-combustion device 412, 512 (FIGS. 4 and 5), are discharged through a conduit 226, 326, 466 or 526. As can be seen in these four Figures, the said conduit may be divided into several branches forming for example two conduits *226a*, *226b* (FIG. 2), *326a*, *326b* (FIG. 3), *466a*, *466b* (FIG. 4), and *526a*, *526b* (FIG. 5).

One, *226a*, *326a*, *466a*, *526a*, of the two conduits serves to discharge a portion or the whole of the dust-containing gases loaded with harmful volatile compounds. The gases flowing through these conduits may be discharged directly to the atmosphere, or they may be processed in any other suitable manner in order to eliminate the harmful volatile compounds before the discharge of the said gases to the atmosphere or, possibly, before their recycling.

The other conduit *226b*, *326b*, *466b*, *526b* allows recycling the other portion of the dust-containing gases to the precalciner 203, 303, 403, 503 or to the preheating system (not shown).

The volatile compounds (alkaline oxides, chlorides, sulfates or the like) can thus be treated and, during the making of calcined products and more particularly of cement clinker, they may concentrate in the apparatus and cause disturbances in its operation.

Lastly, referring to FIG. 6 and according to still another form of embodiment of the present invention, in which the reference numerals are increased by an additional 100 with respect to the form of embodiment of FIG. 5, it is seen that the precalciner is designated by the reference numeral 603.

According to this form of embodiment, the post-combustion device 612 is constituted by the lower portion 670 of the smoke box 608 which has been so modified that its bottom wall 672 is situated at a lower level than that of the bottom wall 601*a* of the kiln. Furthermore, the bottom wall 672 of the smoke box 608 is designed in the form of a fluidizing grate 654 supplied with air through a supply conduit 674 in which is mounted a fan or pressure booster 675. Likewise, this fan or pressure booster 675 is supplied either with the air proceeding from the conduit 618 similar to the conduit 218 of FIG. 2 or with fresh or preheated pure air supplied through the conduit 646 similar to the conduit 546 of FIG. 5. In this form of embodiment, the conduit 611 for the transfer of the powder material from the lower separation stage 606 of the preheating system is not modified and leads to the smoke box 608.

As is thus readily understood and clearly appears from FIG. 6, a fluidized bed is formed in the modified portion 670 of the smoke box 608 between the level of the grate 654 and the level of the bottom 601*a* of the kiln 601.

Furthermore, the powder material is transferred to the kiln 601 by simple overflowing of the fluidized bed.

Moreover, in case particles of powder material should be entrained into the precalciner 603, these particles would thereafter by recycled, and this constitutes an additional advantage of this form of embodiment.

In this form of embodiment as in the forms of embodiment of FIGS. 4 and 5, the post-combustion device of 6 $m^3$ in volume allows obtaining a time of presence of the material and the unburnt combustible of the order of at least 1 min. It is thus seen that in all the forms of embodiment of the invention, the volumes of the post-combustion device remain the same.

Thus, all of the various forms of embodiment of the apparatus of the invention allow obtaining the advantages mentioned earlier while necessitating only quite minor modifications in the presently existing apparatuses, and moreover, the present invention, although it has been described in connection with the making of a hydraulic binder, such as cement clinker, on account of the particularly important advantages obtained, quite unexpectedly to anyone conversant with the art, may be applied more generally to the heat treatment of powder materials necessitating pecalcining and calcining or burning treatments.

What is claimed is:

1. An apparatus for heat treatment capable of being used for the making of a hydraulic binder, such as cement clinker, comprising in combination:

a preheater for preheating a powder material containing a combustible component apt to cause an exothermic reaction with a combustion gas;

a precalciner (403) connected to said preheater and ensuring a primary combustion of said combustible component;

a kiln (401) for heat treatment of the powder material;

a gas-solids separator (406) having: an inlet (410) connected to said precalciner (403) and receiving the mixture of powder material, combustible component and gases therefrom; a first outlet (405) for evacuating the gases towards the preheater; a second outlet (411) connected to said kiln (401) for transferring the separated powder material thereto; and a third outlet (450) for diverting a portion of said powder material flowing from said separator;

a device (412) for post-combustion of combustible component remaining in the powder material, said device being connected to said third outlet (450) of the separator and comprising:

a fluidizing chamber (452) including a grate (454) adapted to provide a fluidized bed of said powder material, and a partition (456) disposed under said grate and dividing said chamber into two sections;

means (457,458) for supplying combustion gas to each of said two sections; and duct means (462) disposed inside said chamber above the grate (454) and including an upper portion communicating with said second outlet (411) of the separator (406) and a lower portion (464) opening in proximity to said grate so that the gas supplied to one of said sections serves to expel the powder material through said duct means to the kiln (401).

2. An apparatus according to claim 1, wherein said chamber (452) further comprises at least one conduit (466*a*) for the discharge of the dust-containing gases loaded with harmful volatile compounds.

3. An apparatus according to claim 1, wherein said chamber (452) comprises at least one conduit (466*b*) connected to said precalciner (403) for recycling a portion of the dust-containing gases thereto.

4. An apparatus according to claim 1, wherein said lower portion (464) of the duct means (462) opens above a nozzle (455) to which said gas is supplied.

5. An apparatus according to claim 1, wherein said chamber (452) has a volume ranging from about 1/10th to about 1/50th of the volume of the precalciner.

* * * * *